United States Patent [19]

Robinson

[11] 4,189,094

[45] Feb. 19, 1980

[54] CONTROL OF HEATING AND VENTILATION SYSTEMS

[75] Inventor: Anthony Robinson, London, England

[73] Assignee: E.S.G. Controls Limited, Cambridge, England

[21] Appl. No.: 875,525

[22] Filed: Feb. 6, 1978

[30] Foreign Application Priority Data

Feb. 10, 1977 [GB] United Kingdom ..... 5496/77

[51] Int. Cl.[2] ..... F23N 5/20; F24F 7/00

[52] U.S. Cl. ..... 236/46 R; 98/33 R; 236/49

[58] Field of Search ..... 165/16; 236/49, 46 R, 236/DIG. 9; 98/33 R; 4/209, 210

[56] References Cited

U.S. PATENT DOCUMENTS

| | | | |
|---|---|---|---|
| 1,949,735 | 3/1934 | Bulkeley | 257/8 |
| 2,217,680 | 10/1940 | Haines | 257/3 |
| 3,130,908 | 4/1964 | Henne | 236/49 |
| 3,402,654 | 9/1968 | Berst | 98/33 |
| 3,844,338 | 10/1974 | Hilgemann et al. | 165/3 |
| 4,037,783 | 7/1977 | Bradford | 236/49 |

*Primary Examiner*—William E. Wayner
*Assistant Examiner*—Harry Tanner
*Attorney, Agent, or Firm*—Boylance, Abrams, Berdo & Farley

[57] ABSTRACT

A control system is provided which automatically varies the degree of ventilation of an indoor swimming pool in response to variations in the outside temperature and comprises separate speed-regulating means for each of the fan-driving motors, each speed-regulating means being operated in response to signals received from a master controller connected to the output of an external temperature sensor. The control system also incorporates means for automatically lowering the level of the temperature to be maintained when the swimming pool is unoccupied, in inverse proportion to the difference between the outside and inside temperatures, this lowering being effected in small increments at relatively long intervals of time.

11 Claims, 5 Drawing Figures

CONTROL OF HEATING AND VENTILATION SYSTEMS

This invention relates to the control of heating and ventilation systems and is particularly concerned with the control of systems for heating and ventilating indoor swimming pools and other building structures in which the avoidance of condensation on the inside surfaces of the structure is of prime importance.

It is generally accepted that if fresh air is continuously supplied to the interior of a swimming pool at a standard rate of 0.015 cubic meters per second for every square meter of the pool water surface, condensation, which can cause serious damage to the fabric and structure of the pool, will be prevented, regardless of external climatic conditions. Continuous ventilation on this scale however, which is well in excess of the needs of the occupants, is expensive and can cost from £10,000 to £30,000 per year for the average public swimming pool.

With a view to reducing running costs, it has now been found that the full rate of ventilation is only required when the temperature outside the building is around freezing point and that the rate of ventilation can be steadily reduced as the temperature rises without causing condensation on the inside surfaces of the pool building. During experiments in which the usual fan motors have been replaced by smaller lower speed motors it has been possible to lower the ventilation rate to one half of the standard rate and although on one occasion the outside temperature fell to 12° C. little or no condensation occurred.

It has also been found that when a swimming pool is closed, e.g. from 21.00 hrs. one evening to 09.00 hrs the next morning, the internal air temperature can be lowered by up to 12° F. without causing condensation, provided that the rate at which the temperature is lowered is sufficiently slow and the total reduction in the internal temperature bears a definite relation to the amount by which the outside temperature is above freezing point.

Following extensive tests a control system has been developed which enables the degree of ventilation of an indoor swimming pool or other building to be automatically varied throughout the twenty-four hours of the day in response to variations in the outside temperature and thus provide an adequate degree of ventilation for the maximum number of people which the building is designed to hold, while avoiding the formation of condensation on the internal surfaces of the building. This control system preferably incorporates means for automatically reducing the internal air temperature when the swimming pool or other building is not occupied and for automatically restoring the temperature to its correct operating level prior to reoccupation.

According to a principal aspect of the present invention, the control system comprises at least two fans for respectively supplying air to and extracting it from the interior of a building, separate driving means for each of said fans in the form of electric motors the speed of which varies with the voltage applied thereto, a temperature sensor mounted externally of the building and means operable in response to the temperature sensed by said sensor for automatically varying the speed of the fan motors in such a manner that the degree of ventilation increases as the outside temperature falls and vice-versa.

The lowering of the temperature at night and during other periods when a building is not in use is a well-established practice known as "setback control" and involves reducing the temperature to be maintained by the heating system at the beginning of the setback period and raising it again to the normal operating level prior to the end of the period.

According to a further aspect of the present invention, there is provided a setback controller which includes means for automatically lowering the level of the temperature to be maintained in inverse proportion to the difference between the outside and inside temperatures, said lowering being effected in small increments of ½° C. to 1° C. at intervals of 20 to 40 minutes.

In this way maximum setback is effected in mild weather conditions and minimum setback in cold weather without condensation forming on the inside surfaces of the building.

One embodiment of the invention, for use in controlling the ventilation of an indoor swimming pool, will be described, by way of example, with reference to the accompanying drawings in which.

Figure 1:
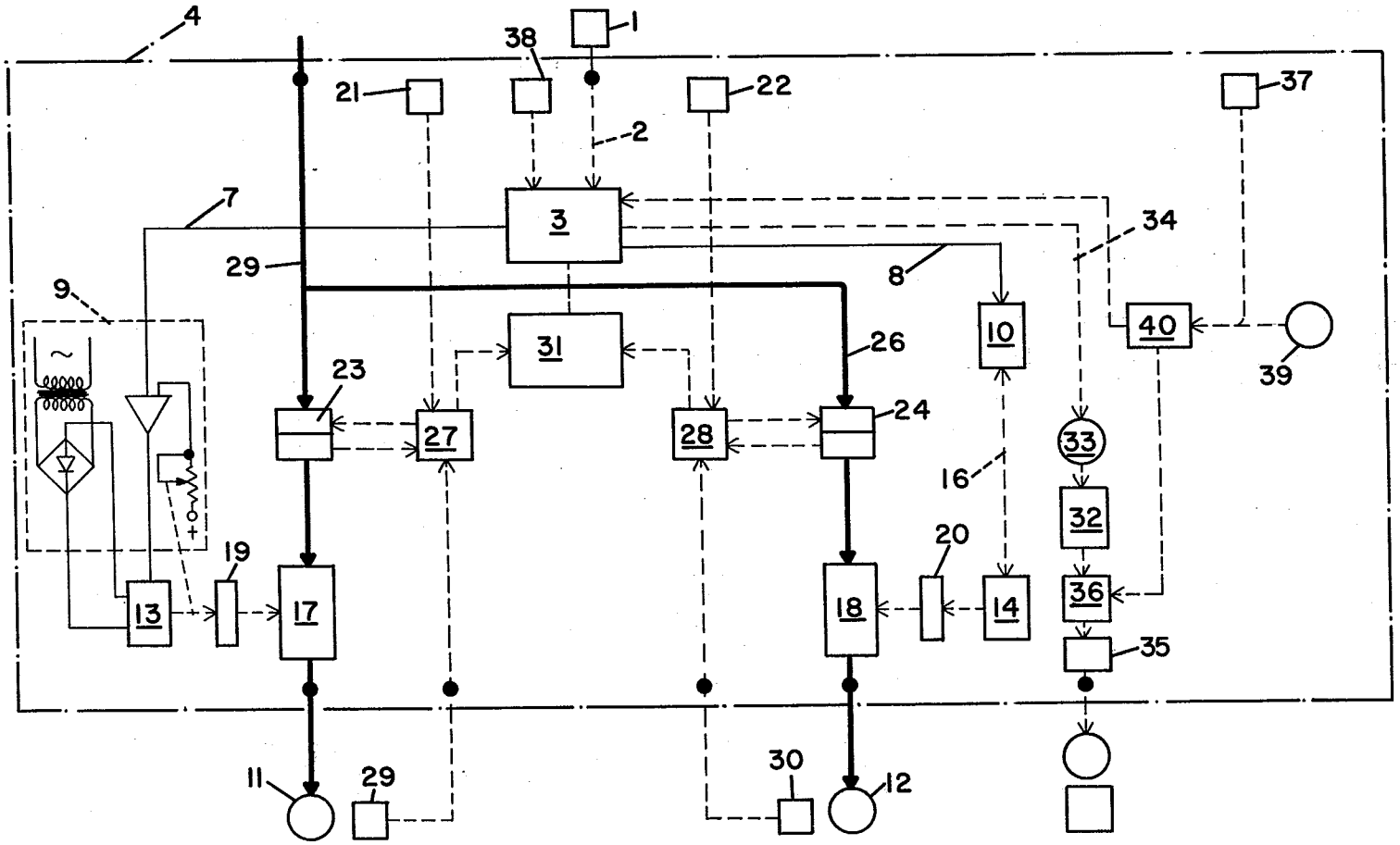
FIG. 1 is a block diagram of the control system.
Figure 2:
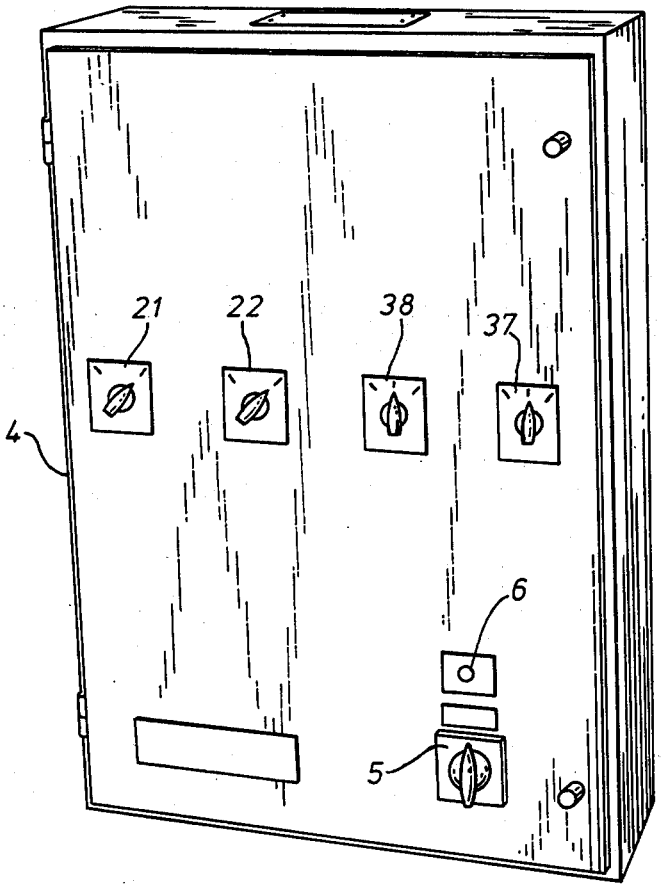
FIG. 2 is a front elevation of the control box.

Referring to FIGS. 1 and 2 a temperature sensor 1 in the form of a negative temperature coefficient thermistor, is enclosed in a weatherproof box mounted on the north wall of the building. The sensor 1 is electrically connected by a line 2 to the input of a power-operated master controller 3 which is mounted in a dust and water-proof control box 4 made of mild steel. The control box 4 is located inside the building and provided with a key-operated lock (not shown), an isolating door switch 5 and a neon lamp 6 for indicating when the power is on. The master controller 3 comprises a mains transformer, a solid state bridge, amplifier circuits and means for applying its output through lines 7 and 8 to two power-operated servo-controllers 9 and 10 mounted in the control box 4. The servo controllers 9 and 10 contain the same basic components as the master controller 3 and have means for applying their outputs to the driving motors of a supply fan 11 and an extraction fan 12 respectively through separate speed regulating mechanisms.

Figure 3:
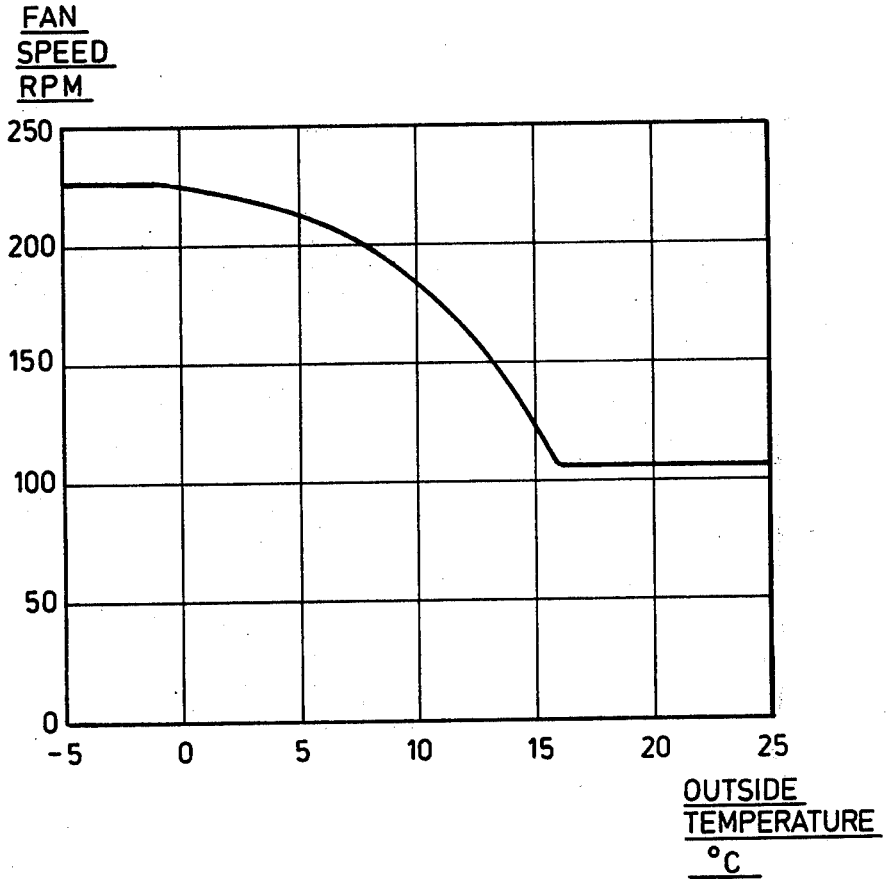
FIG. 3 is a graph showing the manner in which the speed of the fans is varied in accordance with changes in outside temperature.

Each speed regulating mechanism comprises a modulating control motor 13 or 14 incorporating a feedback potentiometer, for translating the electrical signals received through a line 15 or 16 from the associated servo controller 9 or 10 into a motor shaft output, a speed regulator 17 or 18 which comprises a continuously adjustable auto-transformer the output of which is employed to drive the associated fan motor and a gear train 19 or 20 connecting the output shaft of the modulating motor to the speed regulator. These electro-mechanical speed-regulating mechanisms may be replaced if desired by wholly electronic systems. The wide range of speeds employed causes considerable heating of the windings of conventional fan driving motors and for this reason it is necessary to employ specially wound motors having different characteristics for driving the supply fan 11 and the extraction fan 12 and to employ separate mechanisms for controlling the speed of these motors with a view to maintaining the fan outputs equal to each other and so avoiding any differences in pressure between the pool itself on the one hand and the changing areas, halls, cafeterias, etc. on the other hand, which would lead to chlorinated air from the pool entering and mixing with the air in the other areas and vice versa. The graph in FIG. 3 shows the way fan motor voltage is varied as the outside temperature changes.

On/off switches 21 and 22 for the fans 11 and 12 respectively are provided on the control box 4 and because variable speed motors cannot be started below a certain applied voltage the switches 21 and 22 are connected to starting contactors 23 and 24 in power supply lines 25 and 26 to the fans 11 and 12 through power-operated delay timers 27 and 28 respectively, through which the contactors 23 and 24 and local isolators 29 and 30, located outside the control box adjacent their respective fans, are connected to the master controller 3 via a relay 31. This arrangement ensures that on restarting after an interruption of the main power supply, the fans 11 and 12 are kept disconnected while the control system is run up to maximum voltage and the automatic control is not re-engaged until the fans have been re-started. Failure of the controls will not stop the fans which are kept running as long as the on/off switches 21 and 22 and the local isolators 29 and 30 are in the on position. Failure of the controller 3 or the servo 9 and 10 or the motors 13 and 14 will leave the transformers 17 and 18 supplying a fixed voltage to the fan motors. As a result these will run at a constant speed until the automatic controls referred to above are put back into operation.

The incremental or stepwise operation of the setback control is effected by a step controller 32 mounted in the control box 4 and driven by a modulating motor 33 also mounted in the control box and connected through a line 34 to a further output of the master controller 3. The step controller 32 preferably comprises from six to ten sequentially operable switches (not shown) and the outputs from the step controller are fed at predetermined intervals to setback operating controls 35 by a cyclic cam timer 36. The step controller is returned to its starting position upon interruption of the power supply and before reconnection of the load by a recycling switch (not shown). The number of switches operated in the step controller 32 is proportional to the amount by which the outside temperature signalled to the master controller 3 exceeds a datum which may be 0° C. The control box 4 is also provided with switches 37 and 38 which enable the setback controls and the ventilating controls to be switched out of the circuit leaving the fans 11, 12 running at full capacity should this be required for any reason.

The switch 37 has three positions, "hand", "off" and "auto". The "hand" position provides night setback at all times, the "Off" position cuts out the night setback control system at all times and the "auto" position provides night setback of the heating and ventilation system during a selected night period when the pool is not in use. The selected period is governed by a power-operated time switch 39 connected to the master controller 3 and the cyclic cam timer 36 through a relay 40.

Figure 4:
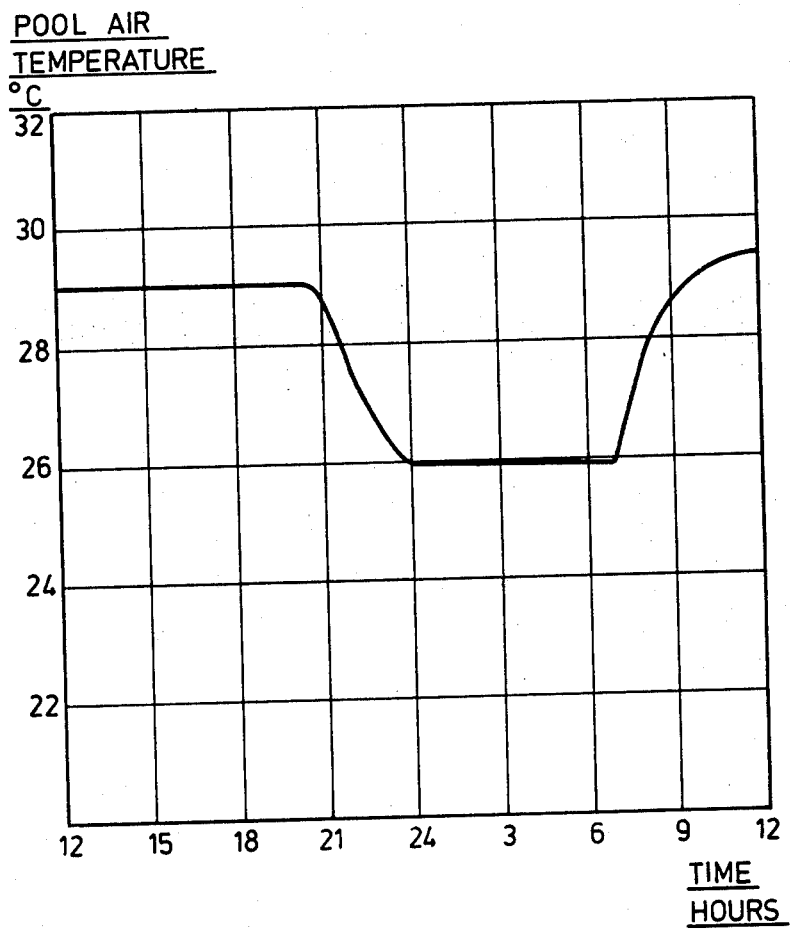
FIG. 4 is a graph showing the manner in which the air temperature in the swimming pool is lowered during a night setback period.

The time switch 39 allows the setback period to be varied as required. When the switch 39 initiates the setback period it lowers the pool air temperature control point by less than 1° C. at half-hourly intervals. At the end of the night period the time switch disengages the setback controls and restores the temperature control point to normal. Typical operating results of the night setback controls are shown in FIG. 4.

The switch 38, which is connected in the operating circuit of the master controller 3, also has three positions: "high", "auto" and "low". The "high" position provides continuous ventilation at the maximum rate without any variation and is conveniently used for testing the pool ventilation system or when the pool is being used for a competion and contains an abnormally large number of spectators requiring additional ventilation or for providing a temporary high rate of ventilation after the system has been shut down. The "auto" position provides automatic control of the ventilation in the manner already described and the "low" position provides similar automatic operation of the system but at a substantially lower level than that provided by the "auto" position, e.g. at a level suitable for operating the ventilation system when the pool is closed down.

In addition, the master controller 3 may incorporate variable controls so that the temperature range for ventilation and night setback control can be varied. All the equipment employed is of standard manufacture and readily replaceable.

The control system according to the invention is designed to ensure that the rate of ventilation is maintained at a maximum when the outside temperature is at freezing point and that for given outside temperatures above freezing point the the rate of ventilation is proportionately lowered. This relation is not linear but is matched to the varying dew-point temperature condition for the inside surfaces of the building. When the outside temperature rises to approximately 15° to 18° C. the ventilation rate is reduced by a maximum amount of between one-half and two-thirds of full ventilation rate and remains at this level during further rises in the outside temperature.

The relatively small size of the control box 4 allows the equipment to be readily incorporated in an existing boiler or service room. The box 4 incorporates its own ventilation system to ensure that none of the components therein are adversely affected by the high temperatures which can be experienced.

Installation of the system, which is fully automatic, can be carried out without any interruption to the normal use of the pool and any failure of the system will not cut out the fans which will continue to operate independently.

The commissioning of the system involves measuring the existing level of ventilation and calculating from the number of users of the building and the details of the structure, the minimum level to which ventilation can be reduced. The control gear is then set up based upon this information with the speed regulating mechanism for each fan motor set to give the maximum degree of fan speed reduction consistent with maintaining the relative humidity of the inside air below the dew-point condition for the internal surfaces of the building and thus preventing condensation. The necessary adjustments are made by varying the settings of the speed regulating mechanisms and setting the control ratio for the master controller. The extent of setback required at night or at other times is determined by the insulation properties and thermal mass of the building structure. During commissioning the system should be tested throughout the full range of ventilation and temperature control.

Figure 5:
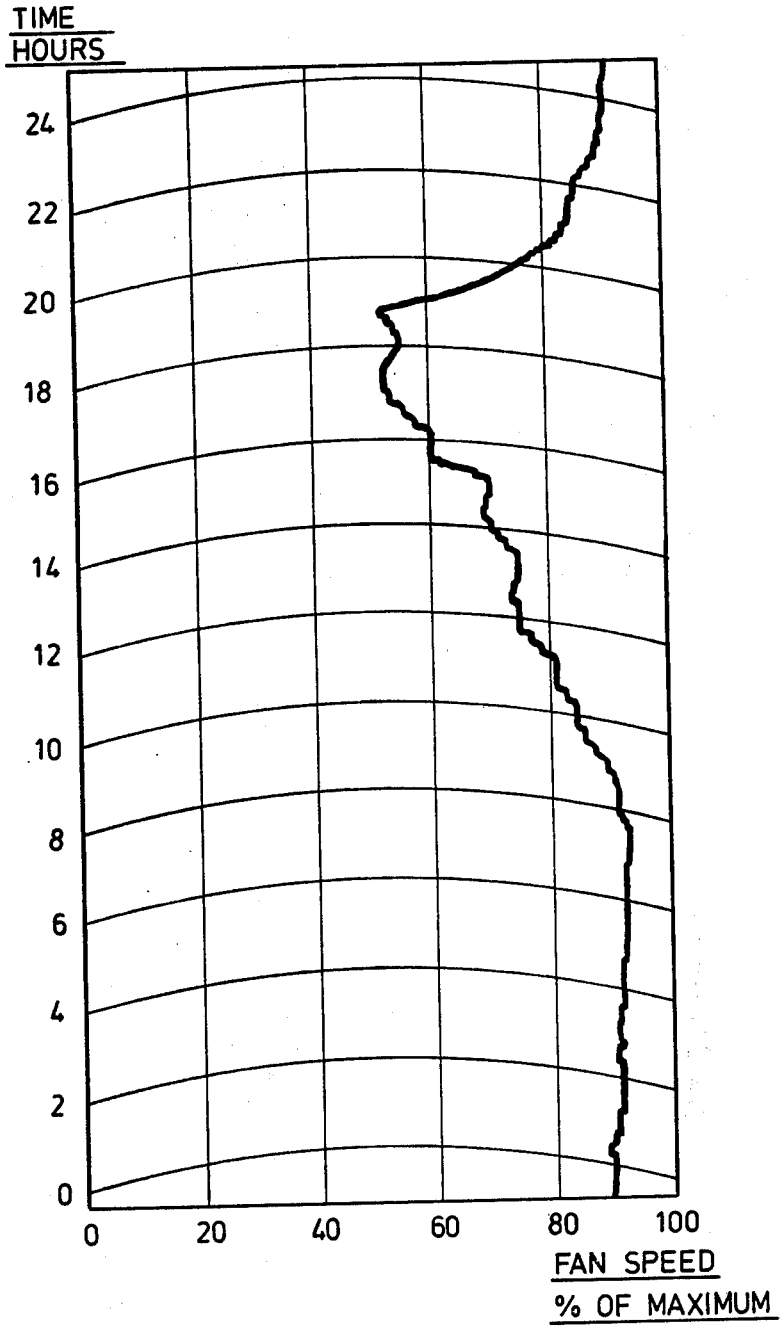
FIG. 5 is a graph showing the manner in which the speed of the supply fan is varied during a typical 24 hours of operation.

During commissioning the settings for the control system are carefully adjusted to suit the particular conditions and do not require subsequent alteration. There are two control parameters. Firstly the range of variation possible in the ventilation system can be varied from 0–75% of the maximum. Secondly, the temperature range can be adjusted into any band between 0°–30° C. A typical 24 hour pattern of operation is shown in FIG. 5. Apart from the brushes for the autotransformers, no other components need routine replacement.

The extent to which savings can be achieved will depend upon the construction of the pool and the details of the arrangements for its ventilation. In particular poor U-values for the fabric and sub-standard ventilation will reduce possible savings. Actual experience with a modern pool incorporating double glazing has shown that an average reduction in the ventilation rate of 35% can be achieved. In addition the night setback control system allows heating costs to be reduced by up to 10%. In addition, proportionately higher savings are obtainable on the cost of electrical power absorbed by the fan motors since the power requirement of a fan is proportional to the cube of the fan speed and, allowing for the usual energy losses due to the decreasing efficiency of the motors as the speed is reduced, when the fans are running at half-speed the electrical power consumed is approximately one-third of the power required at full speed.

Based upon experience in a modern pool total savings are estimated at just over 25% of the annual cost of boiler fuel. This means that the cost of the installation of the control system in a typical indoor pool can be recovered in one to two years. Annual maintenance and running costs of the control gear itself are not significant in relation to the running cost savings.

I claim:

1. A ventilation control system for a building housing an indoor swimming pool, comprising at least two fans for respectively supplying air to and extracting it from the interior of the building, separate driving means for each of said fans in the form of electric motors the speed of which varies with the voltage applied thereto, a temperature sensor mounted externally of the building and means operable in response to the temperature sensed by said sensor for automatically varying the speed of the fan motors as an inverse function of the sensed outside temperature such that said fan driving motors are operated at maximum speed for maximum ventilation at a preselected minimum outside air temperature and at a fixed lower speed at and above a preselected higher temperature, whereby total energy consumption of the fans is reduced.

2. A ventilation control system according to claim 1, wherein said fan motors are separately connected to a common electrical power supply through voltage regulators each of which is driven by a modulating motor and all the modulating motors are operable in accordance with the outside temperature by a master controller connected to the output of said temperature sensor.

3. A ventilation control system according to claim 2, wherein said master controller is connected to the individual modulating motors through separate servo controllers.

4. A ventilation control system according to claim 3, wherein said master controllers and said servo controllers each comprises a mains transformer, a solid state bridge and amplifier circuits.

5. A ventilation control system according to claim 3, wherein each modulating motor incorporates a feedback potentiometer and is connected to receive signals from one of said servo controllers and translate them into a motor shaft output which is transmitted through gearing to the shaft of a continuously adjustable autotransformer constituting one of said voltage regulators.

6. A ventilation control system for a building housing an indoor swimming pool, comprising at least two fans for respectively supplying air to and extracting it from the interior of the building, separate driving means for each of said fans in the form of electric motors the speed of which varies with the voltage applied thereto, a temperature sensor mounted externally of the building and means operable in response to the temperature sensed by said sensor for automatically varying the speed of the fan motors as an inverse function of the sensed temperature over a predetermined temperature range such that the degree of ventilation increases as the outside temperature falls and vice-versa, and wherein said fan motors are separately connected to a common electrical power supply through voltage regulators each of which is driven by a modulating motor and all the modulating motors are operable in accordance with the outside temperature by a master controller connected to the output of said temperature sensor, said system further including setback controls for reducing the reference value for the temperature and quantity of the air which is required to be supplied during periods when the building is not occupied, including manually operable means connected to said master controller for selecting the commencement and duration of the setback period, a step controller provided with a plurality of sequentially operable switches for varying said temperature point, a cyclic cam timer for feeding the outputs from said step controller to the pool heating controls and a modulating motor for driving said step controller in accordance with signals received from said master controller.

7. A ventilation control system according to claim 6, wherein said fan motor speed controls and said setback controls are housed in a dustproof and water-proof control box located in the building and provided on its outer surface with manually operable switches for said fan motors, master conttoller and setback controls.

8. A ventilation control system according to claim 7, wherein said fan motor switches are connected to contactors in the supply lines to the fan motors through separate delay timers which are connected through a relay to the master controller and are adapted to prevent operation of the fan motors until the operating voltage has reached a predetermined minimum value.

9. A ventilation control system according to claim 8, wherein said fan motors are provided with local isolating switches which are connected to said contactors through said delay timers.

10. A ventilation control system according to claim 1, which is automatically operable to provide a fixed rate of ventilation should the automatic controls fail or be switched out.

11. A system according to claim 1 wherein said minimum outside temperature is about 0° C. and said preselected higher temperature is about 15° C.

* * * * *